US007901295B1

(12) United States Patent
Bush, III

(10) Patent No.: US 7,901,295 B1
(45) Date of Patent: Mar. 8, 2011

(54) RAIL—GOLF SWING GUIDE

(76) Inventor: Tony Bush, III, San Rafael, CA (US)

( * ) Notice: Subject to any disclaimer, the term of this patent is extended or adjusted under 35 U.S.C. 154(b) by 0 days.

(21) Appl. No.: 12/880,094

(22) Filed: Sep. 11, 2010

Related U.S. Application Data

(60) Provisional application No. 61/276,390, filed on Sep. 11, 2009.

(51) Int. Cl.
*A63B 69/36* (2006.01)

(52) U.S. Cl. ..... 473/218; 473/266

(58) Field of Classification Search ..... 473/218, 473/219, 257, 261, 262, 263, 264, 265, 266, 473/270, 271, 272, 273, 275, 276, 277, 409
See application file for complete search history.

(56) References Cited

U.S. PATENT DOCUMENTS 4,355,809 A 10/1982 Swett
4,699,384 A * 10/1987 Bechler et al. ..... 473/264
5,599,240 A * 2/1997 Feldmeier ..... 473/218
5,860,871 A 1/1999 Marley
6,059,668 A 5/2000 Marley
6,939,242 B1 9/2005 Battersby
7,261,653 B2 * 8/2007 Thornburg et al. ..... 473/409
7,491,132 B2 2/2009 Bush et al.

* cited by examiner

*Primary Examiner* — Nini Legesse

(74) *Attorney, Agent, or Firm* — Steven A. Nielsen; Allman & Nielsen PC

(57) ABSTRACT

The Rail, rail or rail assembly uses a turret assembly to secure a swing plane rod. The tension of the turret assembly is adjusted such that the swing plane rod stays in place, yet yields to impact from a golf club. The swing plane rod guides the shaft section of a golf club along a swing plane spanning the shoulder height to the foot level of the golfer. A stabilizer rod attaches to one end of the rail and may be used to indicate the golf ball position relative to a golfer's feet. The stabilizer rod also acts as a counter force to keep the rail from tipping over due to the position of the swing plane rod.

5 Claims, 7 Drawing Sheets

RAIL—GOLF SWING GUIDE

RELATED PATENT APPLICATION AND INCORPORATION BY REFERENCE

This is a utility application based upon provisional U.S. patent application Ser. No. 61/276,390 "Rail—golf swing guide" filed on Sep. 11, 2009. This related application is incorporated herein by reference and made a part of this application. If any conflict arises between the disclosure of the invention in this utility application and that in the related provisional application, the disclosure in this utility application shall govern. Moreover, the inventor(s) incorporate herein by reference any and all patents, patent applications, and other documents hard copy or electronic, cited or referred to in this application.

BACKGROUND OF THE INVENTION (1) Field of the Invention

The invention generally relates to golf swing training devices and methods. More particularly, the invention relates to rail swing guides used to learn a proper golf swing and to obtain proper body alignment.

(2) Description of the Related Art

U.S. Pat. No. 7,491,132 by Bush et al, (the '132 patent) discloses a method and apparatus for teaching a golf swing by use of angled panels located at ankle height. The '132 patent fails to disclose or anticipate means of guiding a golf swing when the club head and club shaft are above knee level.

U.S. Pat. No. 6,939,242 by Battersby (the '242 patent) discloses a golf instruction apparatus and method for guiding a golf club head along a circular path. The '242 patent fails to disclose or anticipate means of guiding a golf swing by guiding the shaft of the golf club.

U.S. Pat. No. 6,059,668 by Marley (the '668 patent) discloses a golf swing trainer using an attachment piece connected to the golf club. The '668 patent presents a cumbersome golf club attachment that adds weight to the club and detunes a golfer's swing.

U.S. Pat. No. 5,860,871 by Marley (the '871 patent) discloses a golf club swing training device that uses a head beam of light to guide a student's swing plane. The '891 patent fails to disclose or anticipate the use of a solid element used to guide a golf club shaft along a desired swing plane.

U.S. Pat. No. 4,699,384 by Bechler et al (the '384 patent) provides a stick base and stick rod used upon the ground and placed at an angle to one another to create a visual guide. The '384 patent attempts to create an interaction with the golf club head to guide the upstroke of a golf swing. The '384 patent fails to provide a guide for a golf club shaft that is above ankle height.

U.S. Pat. No. 4,355,809 by Swett (the '809 patent) provides a vertical reference pole mounted to one end of a slidable ball holder. A pointer pole with a magnet indicates if a swinging golf iron is aligned to hit the ball. The '809 patent fails to provide a swing guide and merely provides an alignment tool for a club head, as the club head has reached the ground.

BRIEF SUMMARY OF THE INVENTION

The present invention overcomes shortfalls in the related art by presenting an unobvious and unique combination, configuration and use of components that have achieved unexpected results in guiding a golf swing. The known related art fails to disclose, suggest, teach or anticipate the disclosed components or methods this disclosure.

A new rail or rail rod, lies upon the ground in line with the golf hole or target. The placement of the rail establishes a target line for the golfer to use as a basis in deriving a parallel line to stand along. The disclosed rail system includes a unique turret attachment assembly or ball joint assembly which secures a swing plane rod such that the swing plan rod may be positioned to guide a golf shaft along a desired swing plane. The use of a turret shell, turret ball, ball tensioner stud, turret shell and other components creates a mechanism allowing a golfer to adjust the tension in which the swing plane rod is attached to the rail. A golfer may use typical golf cleats or a golf cleat spike wrench to turn a pair of spike wrench voids found at the bottom side of the ball tensioner stud.

A stabilizer rod is sometimes stored within the swing plane rod. The stabilizer rod may be attached to or within the rail to provide stabilization or support to the rail. The stabilizer rod may also be used as a foot guide in helping a golfer achieve a proper stance.

In one embodiment, the rail or rail rod is placed upon the ground in line with a target to establish a target line for the golfer to stand parallel to. A stabilizer rod is then inserted into the rail to stabilize the rail and to indicate the ball position relative to the golfer's feet. A swing plane rod is secured by a disclosed turret assembly allowing the golfer to fully adjust the swing plane rod and to adjust the tension in which the swing plane rod is secured. The swing plane rod may be set to any angle of any golf club in order to establish a visual and physical indication of a proper swing plane.

The disclosed mechanisms comprise a lightweight, durable and portable golf swing guide for directing and teaching the proper swing plane for drivers, woods, irons and wedges. Disclosed embodiments also teach the proper ball position for woods, irons and wedges.

Embodiments of the disclosed systems may be used with the golf ball on the outside, (relative to the player) of the rail for the better player. Here, the objective is to keep the better player from getting too steep on the downswing. For the novice player, the ball can be played on the inside (relative to the player) with the objective being to swing the club under the swing plane guide.

By virtue of the disclosed turret assembly and related components, the swing plane rod is safely knocked down and out of the way if struck by a golf club on the down swing. The turret assembly provides unexpected results by allowing the swing plane rod to move down with struck, thus preventing damage to the golfer or the golfer's equipment.

One embodiment of the disclosed invention, sometimes called "The Rail" overcomes shortfalls in the known related art by providing multiple benefits and uses within one lightweight tool. Unlike many artifacts in the related art, the disclosed rail system can benefit advanced players as well as beginners. By providing a visual and physical guide to the swing or swing plane, the disclosed system take the mystery out of the proper position of the club through several key swing zones, from the address position through the hip height. By being lightweight and compact, the golfer is encouraged to keep the disclosed rail guide system in a golf bag for easy access and use during practice.

The stabilizer rod may be inserted into the rail during use. The stabilizer rod may then be stored within the swing plane rod. The swing plane rod, as attached to the disclosed turret assembly, may be turned up to 90 degrees from a playing position to a folded position resting into the groove section of the rail or base. The rail or base may then be inserted into a golf back for storage, transport and use during practice.

REFERENCE NUMERALS IN THE DRAWINGS

Figure 1:
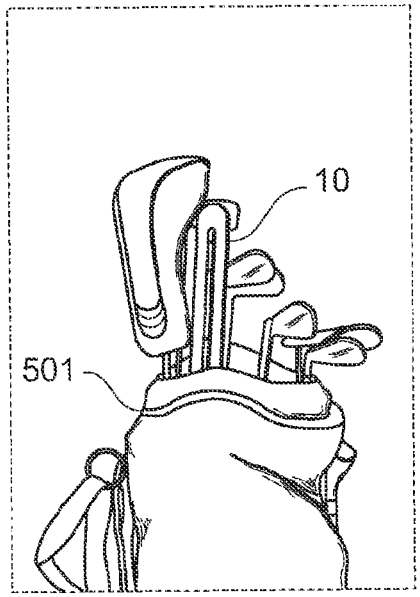
FIG. 1 is a perspective view of one embodiment of the invention as stored within a golf bag.

10 one embodiment of the invention in general
100 rail rod, rail, "The Rail", or base
101 vertical void at the proximal end of rail rod for accepting ball tensioner stud
102 female threads found along vertical void 101 within the rail rod
103 general area at proximal end of rail rod or rail used to secure turret assembly
104 center groove section in the middle of the rail. May be used to cup the swing plane rod during storage.
105 void within rail at distal end of rail, used for accepting stabilizer rod.
106 void within rail at proximal end of rail (near turret assembly) used for accepting stabilizer rod.
200 stabilizer rod
300 swing plane rod
301 cap to swing plane rod
302 male screw of swing plane rod, used to secure swing plane rod to turret ball.
400 turret attachment assembly or turret assembly
401 lower void within turret for accepting ball tensioner stud
402 upper void within turret shell for exposing void within turret ball 455 and female threads 456 within turret ball
450 ball tensioner stud
451 lower void for ball tensioner stud
452 turret shell
453 turret ball
454 female threads within turret ball
455 void within turret ball
456 bottom side of ball tensioner stud
457 spike wrench voids found at bottom side of ball tensioner stud
458 ball recess found on top side of ball tensioner stud
459 top side of ball tensioner stud
460 threads on outside circumference of ball tensioner stud
500 golf ball
501 golf bag
600 golf club
601 club section of golf club
602 shaft section of golf club
700 golfer
701 feet of golfer These and other aspects of the present invention will become apparent upon reading the following detailed description in conjunction with the associated drawings. The present invention overcomes shortfalls in the related art by combining directional microphone solution with an adaptive noise cancellation algorithm. Economies in hardware and power consumption are obtained by two microphones sharing the front-end hardware. These modifications, other aspects and advantages will be made apparent when considering the following detailed descriptions taken in conjunction with the associated drawings.

DETAILED DESCRIPTION OF EMBODIMENTS OF THE INVENTION

The following detailed description is directed to certain specific embodiments of the invention. However, the invention can be embodied in a multitude of different ways as defined and covered by the claims and their equivalents. In this description, reference is made to the drawings wherein like parts are designated with like numerals throughout.

Unless otherwise noted in this specification or in the claims, all of the terms used in the specification and the claims will have the meanings normally ascribed to these terms by workers in the art.

Unless the context clearly requires otherwise, throughout the description and the claims, the words "comprise," "comprising" and the like are to be construed in an inclusive sense as opposed to an exclusive or exhaustive sense; that is to say, in a sense of "including, but not limited to." Words using the singular or plural number also include the plural or singular number, respectively. Additionally, the words "herein," "above," "below," and words of similar import, when used in this application, shall refer to this application as a whole and not to any particular portions of this application.

The above detailed description of embodiments of the invention is not intended to be exhaustive or to limit the invention to the precise form disclosed above. While specific embodiments of, and examples for, the invention are described above for illustrative purposes, various equivalent modifications are possible within the scope of the invention, as those skilled in the relevant art will recognize. For example, while steps are presented in a given order, alternative embodiments may perform routines having steps in a different order. The teachings of the invention provided herein can be applied to other systems, not only the systems described herein. The various embodiments described herein can be combined to provide further embodiments. These and other changes can be made to the invention in light of the detailed description.

All the above references and U.S. patents and applications are incorporated herein by reference. Aspects of the invention can be modified, if necessary, to employ the systems, functions and concepts of the various patents and applications described above to provide yet further embodiments of the invention.

Figure 2:
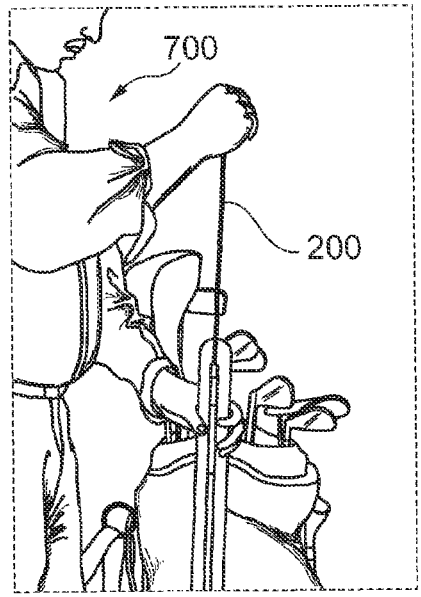
FIG. 2 is a perspective view of one embodiment of the invention wherein a golfer is removing a stabilizer rod from a rail rod.

Referring to FIG. 1, the invention in general 10 is shown within a golf bag 501. FIG. 2 shows a golfer 700 extracting a stabilizer rod 200 from a swing plane rod.

Figure 3:
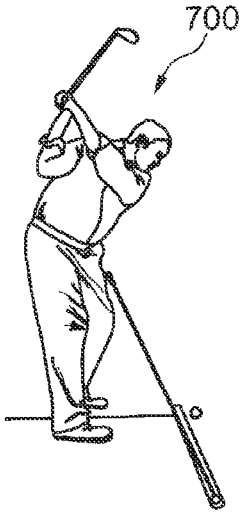
FIG. 3 is an perspective view of a golfer in a back swing position.

FIG. 3 shows a golfer with a golf club in a full back swing. The golfers legs are straddling a stabilizer rod. The golf ball is away from the rail. The swing guide rod is in position, tilted toward the golfer, to create a visual and physical swing plane guide.

Figure 4:
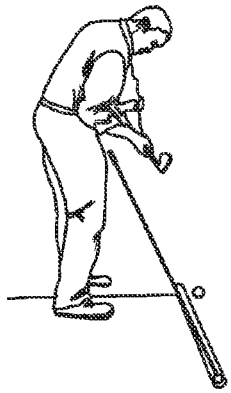
FIG. 4 is a perspective view of a golfer in a mid-swing position.

FIG. 4 shows the golfer with a golf club at hip height, the club shaft swinging parallel to the swing plane guide. Unlike the related art, the swing plane guide provides a visual and physical guide to achieve a proper swing from the golfer's hip height and lower.

Figure 5:
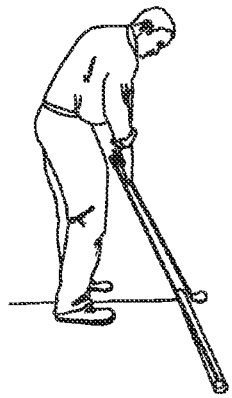
FIG. 5 is a perspective view of a golfer just prior to striking a golf ball.

FIG. 5 shows a club head in position to strike a golf ball. The shaft of the golf club is still in a parallel position to the swing plane rod.

Figure 6:
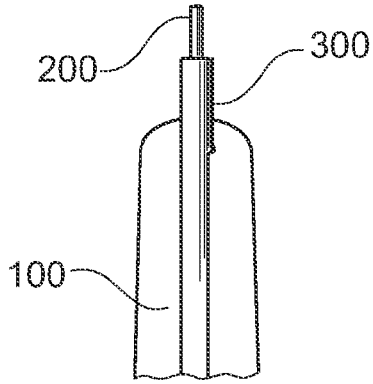
FIG. 6 is a perspective view of a stabilizer rod contained within a swing plane rod.

FIG. 6 shows one embodiment of the invention with the stabilizer rod 200 stored within the swing plane rod 300. The Rail, rail rod, or rail 100 is shown just behind the swing plane rod.

Figure 7:
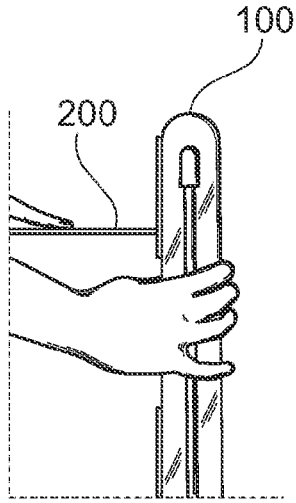
FIG. 7 is a perspective view of a stabilizer rod being attached to a rail rod.

FIG. 7 shows a stabilizer rod 200 being attached into a side wall of the rail 100.

Figure 9:
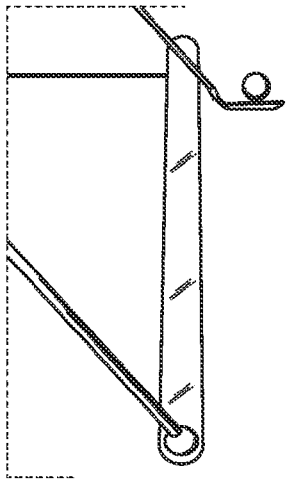
FIG. 9 is a perspective view of a golf ball being struck on the far side of a rail rod.
Figure 8:
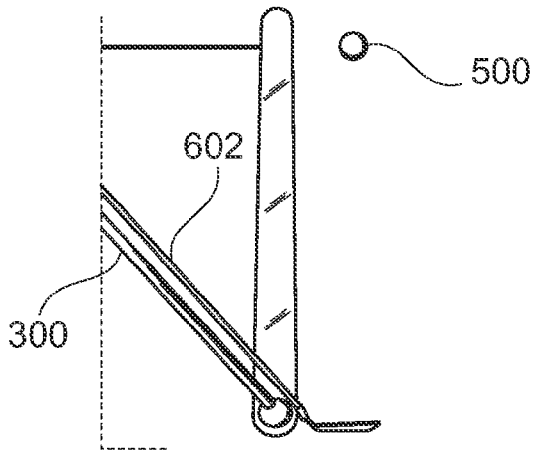
FIG. 8 is a perspective view of a golf club shaft held parallel to swing plane rod.

FIG. 8 shows a golf ball 500 in line with the stabilizer rod as well as a golf club shaft 602 in a parallel position to a swing plane rod. In this configuration the golf ball is said to be on the outside. FIG. 9 shows a golf club in position to strike a golf ball, with the golf ball placed on the outside of the rail, from the perspective of the golfer.

Figure 10:
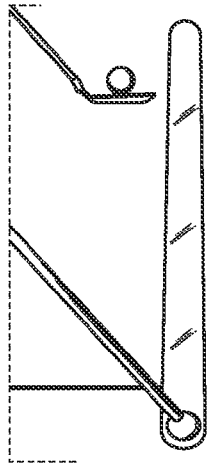
FIG. 10 is a perspective view of a golf ball being struck on the near side of a rail rod.

FIG. 10 shows a golf ball placed on the inside of the rail and shows a stabilizer rod attached in a position adjacent to the swing plane rod.

Figure 11:
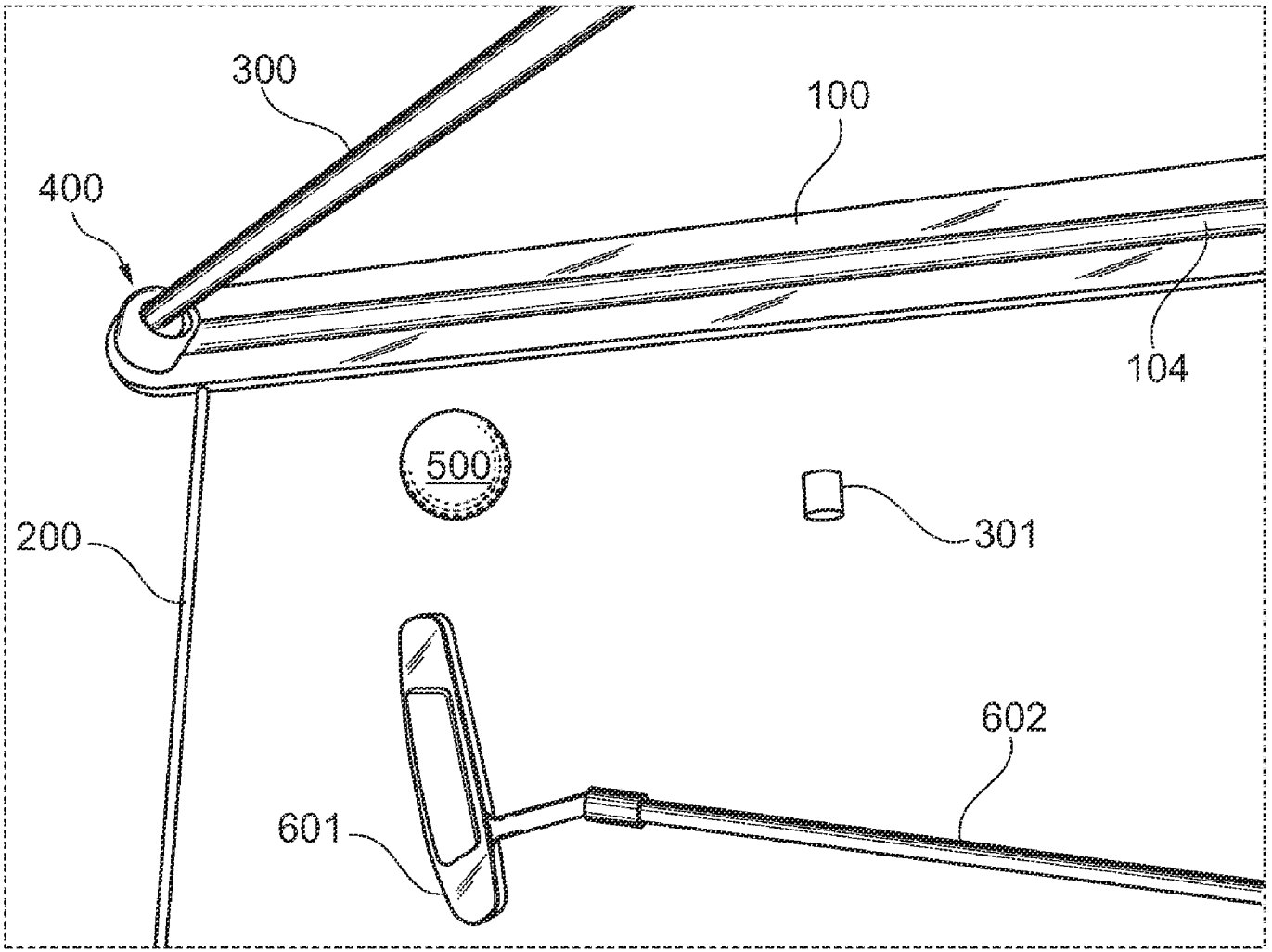
FIG. 11 is a perspective view of various elements of one embodiment of the invention.

FIG. 11 shows a rail 100 with a center groove section which may cup or accept the swing plane rod 300 when folded. A turret attachment assembly or turret assembly 400 attaches the swing plane rod 300 to the rail 100. A stabilizer rod is secured within a void of the rail, the void being adjacent to the turret assembly. A golf ball 500 is shown in front of a club head 601. A golf club shaft 602 is attached to the golf club head. A cap 301 is shown and is sometimes used to cover the swing plane rod to secure a stabilizer rod stored within the swing plane rod.

Figure 12:
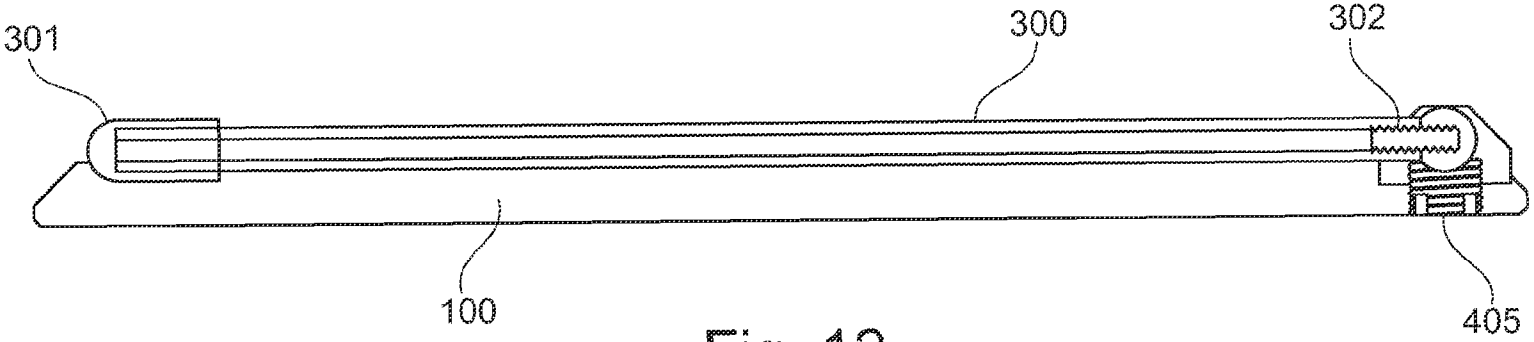
FIG. 12 is a sectional view of one embodiment of the invention.

FIG. 12 is an elevation view of a rail or base 100. A cap 301 to the swing plane rod covers the far end of the swing plane rod. On the proximal end of the swing plane rod, a male screw 302 of the swing plane rod is shown inserted into the female threads of the turret ball.

Figure 13:
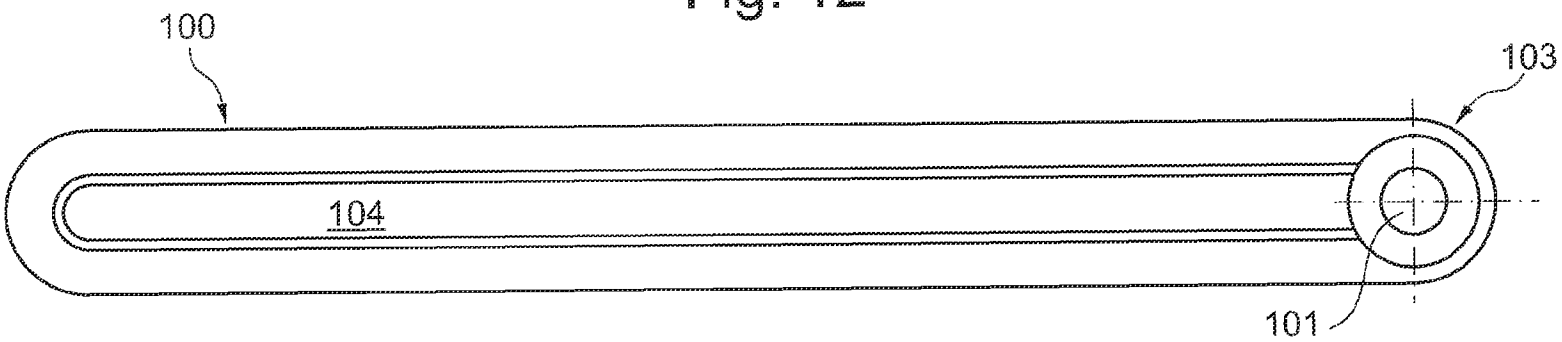
FIG. 13 is a top down plan view of various elements of one embodiment of the invention.

FIG. 13 is a top plan view of a rail 100. A center groove section 104 is shown on the top side of the rail. The center groove section may partially accept or cup a swing plane rod. On the proximal side of the rail a general area 103 is shown ready to accept a turret assembly. A vertical void 101 is shown and may be used to accept a ball tensioner stud and related components.

Figure 14:
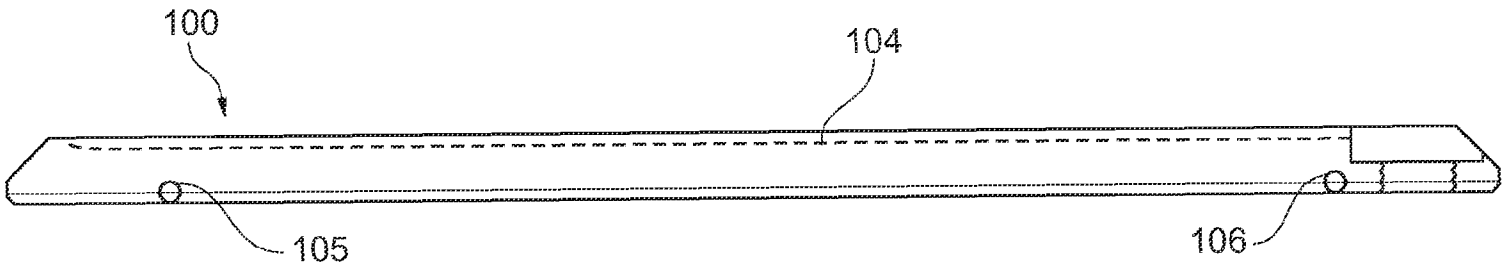
FIG. 14 is an elevation view of a rail rod or rail.

FIG. 14 is a section view of a rail 100. The top side shows a groove section 104 behind a dotted line. A distal void 105 is found within the rail and may be used to secure a stabilizer rod. A proximal void 106, near the end for the turret assembly, may also be used to secure a stabilizer rod.

Figure 15:
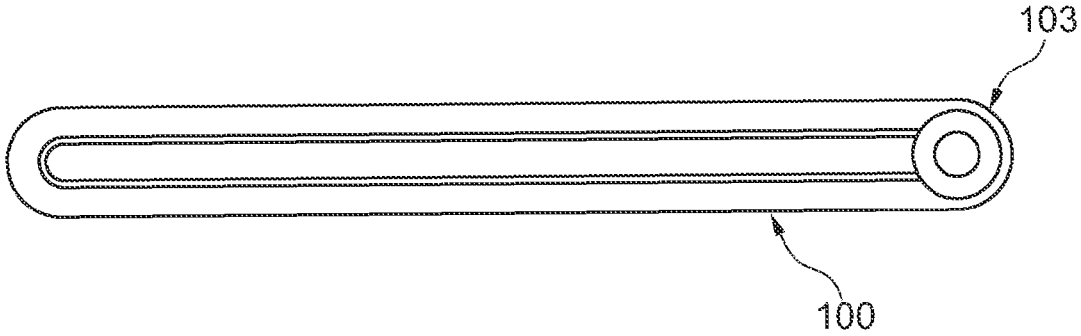
FIG. 15 is a top down plan view of various elements of one embodiment of the invention.
Figure 16:
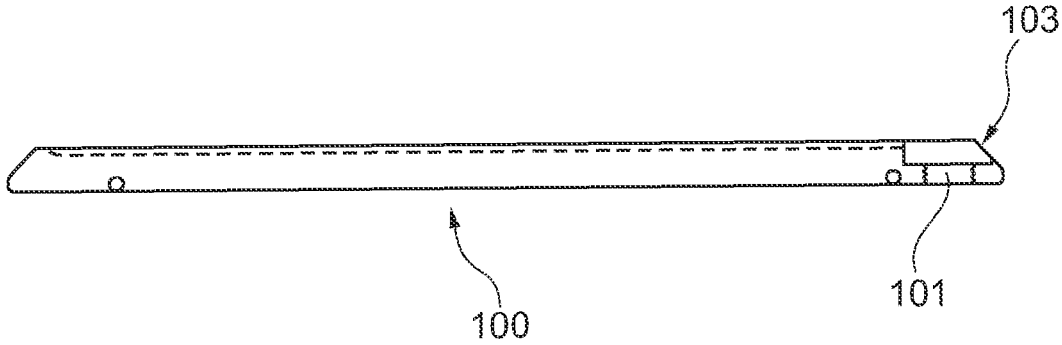
FIG. 16 is an elevation view of a rail rod.

FIG. 15 presents an alternative view of the top side of a rail 100. FIG. 16 presents an alternative section view of a rail 100 and shows a vertical void 101 at the proximal end of the rail. The vertical void 101 may be used to accept a ball tensioner stud.

Figure 17:
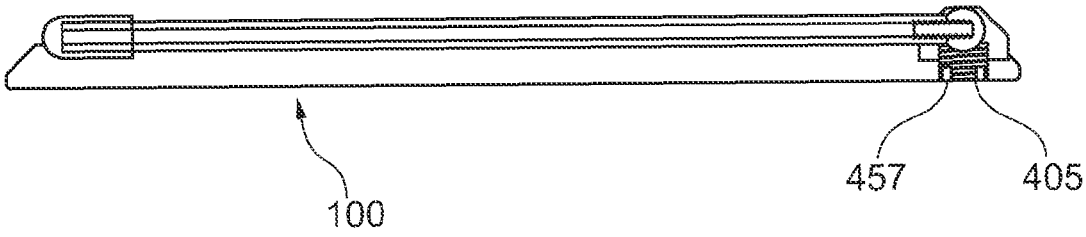
FIG. 17 is a perspective view of various elements of one embodiment of the invention.

FIG. 17 presents an alternative view section view of a rail with a turret assembly attached. Two spike wrench voids 457 are shown and may be used to tighten the ball tensioner stud.

Figure 18:
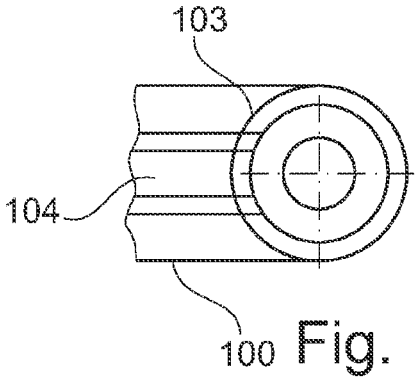
FIG. 18 is a plan view of a turret void.
Figure 19:
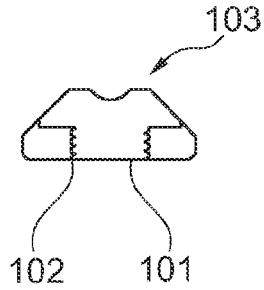
FIG. 19 a sectional view of the turret end of the rail rod or rail.

FIG. 18 presents a close up of the proximal end of a rail 100 prior to insertion of the turret assembly components. FIG. 19 presents a section view of a proximal end of a rail. A vertical void 101 is shown on the bottom side of the rail. The vertical void is defined by a circular wall of female threads 102.

Figure 20:
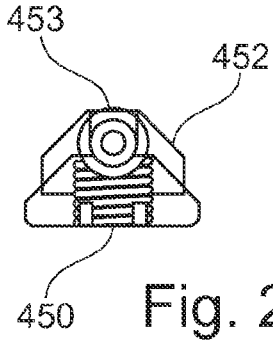
FIG. 20 a sectional view of a turret assembly.
Figure 21:
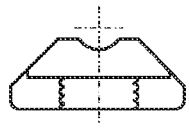
FIG. 21 a sectional view of a rail rod or rail prior to assembly of the turret assembly.

FIG. 20 shows a turret shell 452 containing a turret ball 453 and ball tensioner stud 450. FIG. 21 shows a sectional view of a proximal end of a rail.

Figure 22:
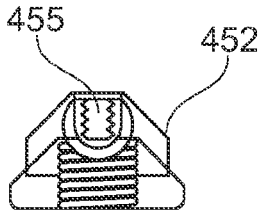
FIG. 22 is a sectional view of a turret assembly with the threads of the ball in a vertical position.
Figure 23:
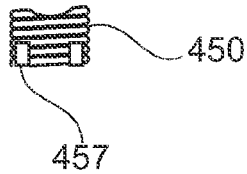
FIG. 23 is a sectional view of a ball tensioner stud.
Figure 24:
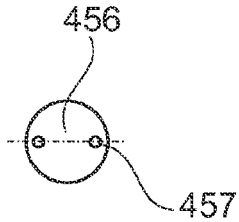
FIG. 24 is a plan view of a bottom side of a ball tensioner stud.

FIG. 22 shows the void 455 within the turret ball. FIG. 23 shows a ball tensioner stud and spike wrench voids 457. FIG. 24 shows the bottom side 456 of a ball tensioner stud and spike wrench voids 457.

Figure 25:
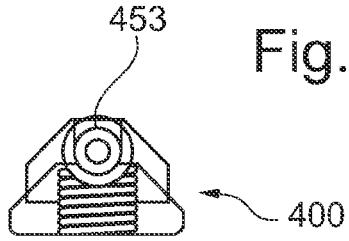
FIG. 25 is a sectional view of a turret assembly with the threads of the ball non in a vertical position.
Figure 26:
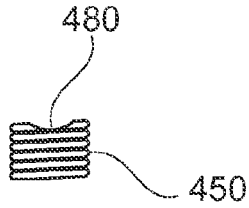
FIG. 26 is an elevation view of a ball tensioner stud.

FIG. 25 shows a turret assembly 400 with a turret ball 453 in place. FIG. 26 shows a ball tensioner stud 450 with a ball recess 458 found at the top side of the ball tensioner stud 450.

Figure 27:
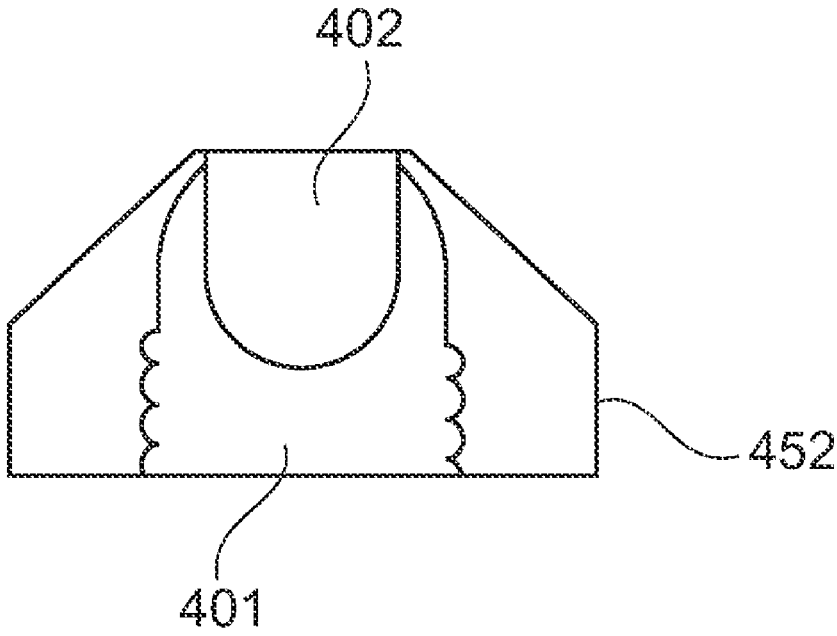
FIG. 27 is a sectional view of a turret shell.

FIG. 27 shows a turret shell 452 with an upper void 402 for exposing the void within the turret ball 455 and female threads 456 within the turret ball. The lower section of the turret forms a lower void 401 for accepting a ball tensioner stud.

Figure 28:
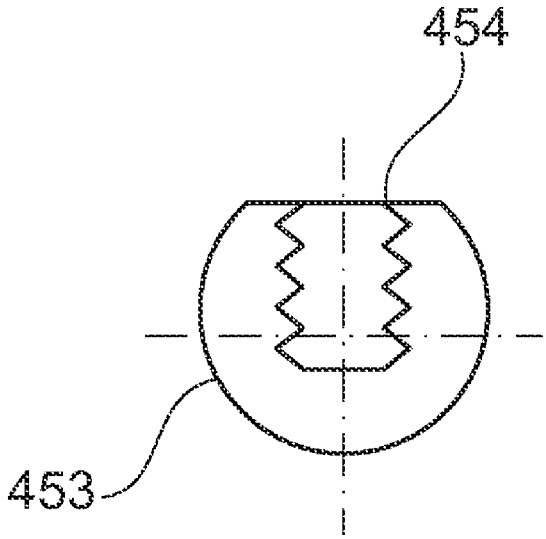
FIG. 28 is a sectional view of a turret ball.

FIG. 28 is a section view of a turret ball 453 shown with a center void defined by female threads 454.

These and other changes can be made to the invention in light of the above detailed description. In general, the terms used in the following claims, should not be construed to limit the invention to the specific embodiments disclosed in the specification, unless the above detailed description explicitly defines such terms. Accordingly, the actual scope of the invention encompasses the disclosed embodiments and all equivalent ways of practicing or implementing the invention under the claims.

Items. The invention includes, but is not limited to the following items described below.

Item 1. A system comprising:

a) a rail 100 having a distal end, proximal end, bottom side, top side with a longitudinal center groove 104, and two longitudinal sides having a distal void 105 and a proximal void 106 capable of accepting a stabilizer rod 200, the rail having a vertical void 101 at the proximal end, with the vertical void capable of accepting a ball tensioner stud 450;

b) the ball tensioner stud 450 inserted into the vertical void 101 of the rail 100, and a turret ball 453 placed on top a ball recess 458 found on top of the ball tensioner stud 450;

c) a turret shell 452 having an upper void 402 capable of exposing a turret ball void 455 and the female threads 456 within the turret ball;

d) the turret shell being secured over the turret ball by use of the ball tensioner stud such that the turret ball and turret shell are fastened to the rail;

e) the ball tensioner stud 450 having a bottom surface 456 defining two or more spike wrench voids 457 able to accept objects used as tools to rotate the ball tensioner stud;

f) a male screw 302 inserted into the female threads of the turret ball 455 and the opposite side of the male screw 302 inserted into a swing plane rod 300;

g) the swing plane rod having a center void capable of containing the stabilizer rod;

i) the swing plane rod extending out from the turret ball and rotating in a circular motion relative to the top side of the rail and the swing plane rod adjustable from 0 degrees to 90 degrees from the top side of the rail.

Item 2. A method of practicing a golf swing, using the system of claim 1, the method comprising:

a) placing a rail 100 upon the ground and in line with a target;

b) adjusting the rotation and vertical angle of a swing plane rod attached to the rail, to match the desired golf club shaft 602 swing angle.

b) inserting a stabilizer rod 200 into a proximal or distal void of the rail;

c) using the stabilizer rod as a foot placement guide;

d) placing a golf ball adjacent to the distal side of the rail; and e) using the golf club to swing at the golf ball while attempting to keep the angle of the golf club shaft in a parallel position to the swing guide.

While certain aspects of the invention are presented below in certain claim forms, the inventors contemplate the various aspects of the invention in any number of claim forms.

What is claimed is:

1. A golf swing practicing system comprising:

a) a rail having a distal end, proximal end, bottom side, top side with a longitudinal center groove, and two longitudinal sides having a distal void and a proximal void capable of accepting a stabilizer rod, the rail having a vertical void at the proximal end, with the vertical void capable of accepting a ball tensioner stud;

b) the ball tensioner stud inserted into the vertical void of the rail, and a turret ball placed on top a ball recess found on top of the ball tensioner stud;

c) a turret shell having an upper void capable of exposing a turret ball void and the female threads within the turret ball;

d) the turret shell being secured over the turret ball by use of the ball tensioner stud such that the turret ball and turret shell are fastened to the rail;

e) the ball tensioner stud having a bottom surface defining two or more spike wrench voids able to accept objects used as tools to rotate the ball tensioner stud;

f) a male screw inserted into the female threads of the turret ball and the opposite side of the male screw inserted into a swing plane rod;

g) the swing plane rod having a center void capable of containing the stabilizer rod; and i) the swing plane rod extending out from the turret ball and rotating in a circular motion relative to the top side of the rail and the swing plane rod adjustable from 0 degrees to 90 degrees from the top side of the rail.

2. A method of practicing a golf swing, using the system of claim 1, the method comprising:

a) placing a rail upon the ground and in line with a target;

b) adjusting the rotation and vertical angle of a swing plane rod attached to the rail, to match the desired golf club shaft swing angle.

b) inserting a stabilizer rod into a proximal or distal void of the rail;

c) using the stabilizer rod as a foot placement guide;

d) placing a golf ball adjacent to the distal side of the rail; and e) using the golf club to swing at the golf ball while attempting to keep the angle of the golf club shaft in a parallel position to the swing guide.

3. The method of claim 2 placing the golf ball on the proximal side of the rail.

4. The method of claim 2 placing the golf ball on the distal end of the rail and wherein the golf ball is placed such that the rail is between a golfer and the golf ball.

5. The method of claim 2 wherein the golf ball is placed in between the rail and a golfer.

* * * * *